US005921066A

United States Patent [19]

Olsson et al.

[11] Patent Number: 5,921,066

[45] Date of Patent: Jul. 13, 1999

[54] WRAPPED PULP BALE, METHOD FOR WRAPPING A PULP BALE AND PUNCHING DEVICE FOR CARRYING OUT THE METHOD

[76] Inventors: Kaj-Ove Olsson, Alvägen 22; Siinto Ikäläinen, Alvägen 2, both of Vallvik, Sweden, S-820 21

[21] Appl. No.: 08/875,891

[22] PCT Filed: Feb. 5, 1996

[86] PCT No.: PCT/SE96/00131

§ 371 Date: Aug. 6, 1997

§ 102(e) Date: Aug. 6, 1997

[87] PCT Pub. No.: WO96/24524

PCT Pub. Date: Aug. 15, 1996

[30] Foreign Application Priority Data

Feb. 8, 1995 [SE] Sweden ..... 9500439

[51] Int. Cl.[6] ..... B65B 51/09

[52] U.S. Cl. ..... 53/476; 53/375.8; 493/351; 493/392

[58] Field of Search ..... 53/476, 375.8, 53/376.4; 493/392, 393, 374, 351, 223, 227

[56] References Cited

U.S. PATENT DOCUMENTS

| | | | |
|---|---|---|---|
| 1,009,644 | 11/1911 | Bump | 493/351 |
| 1,487,079 | 3/1924 | Stillwagon | 493/351 |
| 3,040,473 | 6/1962 | Wetzler | 53/476 X |
| 3,792,563 | 2/1974 | Mercer et al. | 53/375.8 X |
| 5,024,643 | 6/1991 | Kastner | 493/351 |

*Primary Examiner*—James F. Coan
*Attorney, Agent, or Firm*—Terrance L. Siemens

[57] ABSTRACT

The invention relates to a wrapped pulp bale of the kind which, apart from a proper bale, comprises an enveloping wrapping which is folded along opposite faces of the bale while forming mutually overlapping parts in which the paper lies in two or more layers on top of each other. For holding the wrapping against the proper bale, sets of lugs (26) are provided in the overlapping parts of the wrapping, each set of lugs including a number of lugs corresponding to the number of paper layers, which are punched out from the paper layers while leaving through holes therein, and folded along a common folding line (25) as well as jointly inserted between the inside of the innermost layer of paper and the outside of the bale in order to be held therebetween.

10 Claims, 3 Drawing Sheets

WRAPPED PULP BALE, METHOD FOR WRAPPING A PULP BALE AND PUNCHING DEVICE FOR CARRYING OUT THE METHOD

TECHNICAL FIELD OF THE INVENTION

In a first aspect this invention relates to a wrapped pulp bale of the kind which, apart from a proper bale, comprises a wrapping or cover of paper which envelopes the same and which is folded along opposite faces of the bale while forming overlapping parts in which the paper lies in two or more layers on top of each other, the wrapping being provided with means to keep the same against the bale.

PRIOR ART

A usual method for ensuring the keeping of paper covers on pulp bales is to put at least one single steel wire around the individual bale and the cover arranged outside the same, more precisely in such a way that the wire surrounds and braces the very parts of the paper which are folded towards opposite faces of the bale and overlap each other, so that these parts cannot be removed from the faces of the bale. This method is, however, in practice expensive and complicates the process of transporting the bales from the pulp mill to the paper mill, particularly the shredder thereof. Thus, the actual consumption of steel wire causes an inevitable and for every bale repeatedly occurring material cost falling upon the pulp producer. Furthermore, when the bales arrive to the paper mill, the wire has to be removed from the bales before these can be fed into the shredder in question. This calls for a special, mechanical wire-cutting equipment, as well as a particular post-handling of the wire scrap which is left after cutting.

With the purpose of getting away from the use of steel wire, which is price rising in many respects, attempts have been made to keep the paper cover on pulp bales by means of adhesives. Thus, WO91/10594 discloses a packing machine which, in addition to the necessary paper-folding components, comprises a number of adhesive sprayers by means of which the overlapping parts of the paper cover can be internally sprayed with adhesives, which after a certain time of binding (during which special clamp devices hold the overlapping parts pressed to the bale) gives a holding adhesive joint which is able to replace the steel wires. A serious disadvantage of this method is, however, that adhesives represent an extraneous component when the wrapped pulp bales are later on received in the paper mill and in their entirety, that is including the paper cover, defibrated to be taken out in form of a beater to the paper making machine. The paper maker is therefore moderately inclined to directly use such wrapped pulp bales with adhesive-mixed paper covers. The alternative is to remove the paper covers before tearing the bale, but this would in turn imply a bad utilization of the raw material of fibre available in the paper cover itself. In addition, the adhesive is an article of consumption which in itself entails a non-negligible material cost. Another disadvantage is the fact that adhesives require a considerable time to set; something which may create a bottleneck in the packaging line of the pulp mill.

OBJECTS AND FEATURES OF THE INVENTION

The present invention aims at removing the above-mentioned disadvantages of the previously known technique and at creating a wrapped pulp bale which without detriment can be directly used in the paper mill. Thus, a primary object of the invention in a first aspect is to create a wrapped pulp bale the paper cover of which is kept reliably in place without such additional means as adhesives or steel wires. More precisely, the paper cover should be held by using holding means of a mechanical nature included in the cover itself, which means can be produced in an easy and effective way and which do not require any handling at all in the paper mill.

According to the invention, at least the primary object thereof is attained by the features defined in the characterizing clause of claim 1.

In a second aspect, the invention also aims at achieving a bale wrapping method by means of which wrapped pulp bales can be produced in a quick, effective and inexpensive way. The features of this method are defined in claim 4.

In a third aspect, the invention also relates to a punching device for carrying out the method according to the invention. The features of this punching device are defined in claim 5. Preferred embodiments of the punching device according to the invention are furthermore defined in claims 6 to 8.

FURTHER ELUCIDATION OF THE PRIOR ART

In SE 331 025 (U.S. Pat. No. 3,430,413) an envelope of paper intended for the wrapping of bottles is described which is kept in place around the contents by means of foldable lugs which are brought into engagement with each other by means of a special machine. In this case, however, each lug is punched individually before they are interengaged. Furthermore, NO 50 171 discloses a method in which holes are punched in two layers, e.g. of paper, lying on top of each other for the purpose of keeping the layers together. In this case, however, the actual locking takes place by means of adhesive-like materials, such as wax, gum, varnish or the like.

BRIEF DESCRIPTION OF THE APPENDED DRAWINGS

In the drawings:

FIG. 1 is a schematic perspective view illustrating a wrapping station in which a number of punching devices according to the present invention are included and in which a pulp bale wrapped according to the invention is illustrated, FIG. 2 is a front view of a carrier equipped with several individual punching devices, shown behind a bale outlined with dash dotted lines, FIGS. 3 and 4 are longitudinal sections through a punching device according to the invention, shown in two different positions of function, FIG. 5 is a vertical view illustrating how several punching devices separated level-wise may be part of one of two carriers, included in the station according to FIG. 1, FIG. 6 is an enlarged perspective view showing a punching tool included in the punching device according to the invention, and FIGS. 7 to 13 are simplified side views illustrating a number of different steps during the punching of a separate set of lugs according to the invention.

DETAILED DESCRIPTION OF A PREFERRED EMBODIMENT OF THE INVENTION

Figure 1:
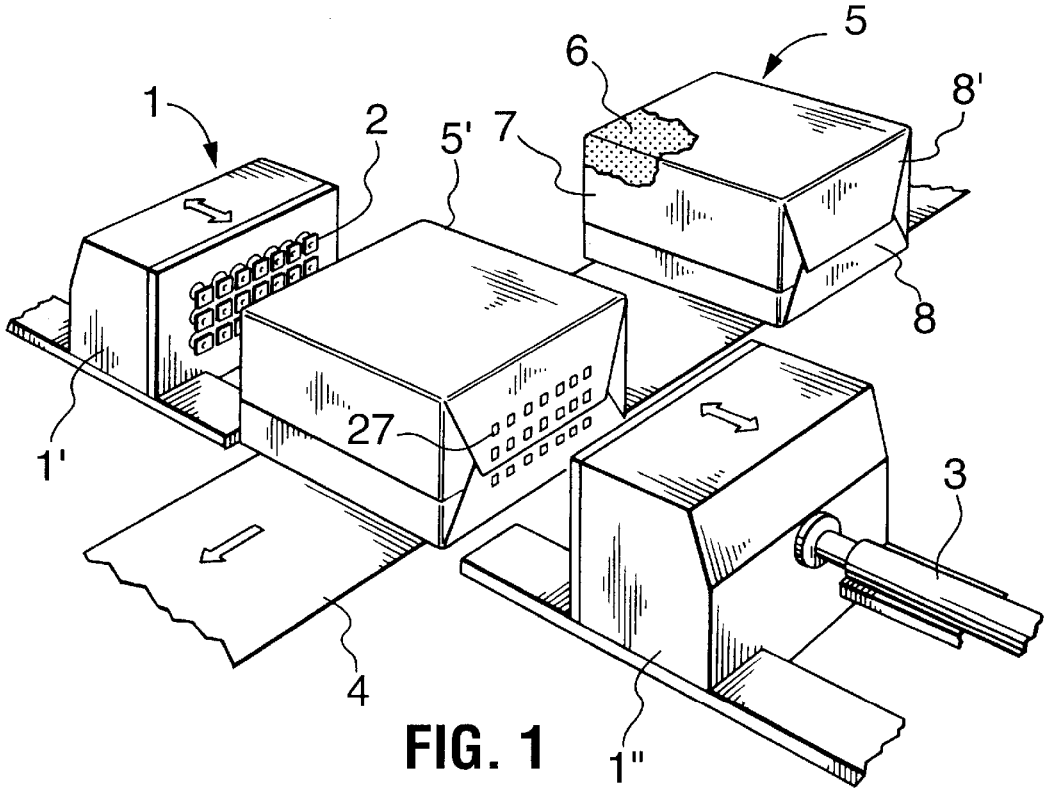

In FIG. 1 a wrapping station is designated 1 in which two carriers 1', 1" are included which comprise a plurality of schematically shown punching devices 2 according to the invention. The carriers 1', 1" have the character of jaws which can be moved linearly to and fro each other, e.g. by means of hydraulic cylinders 3. 4 generally designates a conveying equipment on top of which an arriving pulp bale 5 with adherent paper cover is shown as well as a ready-wrapped bale 5'. As is clearly illustrated in connection with the arriving pulp unit 5, this consists on one hand of a proper bale 6 and on the other hand a wrapping or cover 7 of paper. In a preceding station included in the same packaging line as station 1, the paper cover 7 has been wrapped around the bale 6 as well as folded along opposite faces of the bale while forming parts 8, 8' overlapping each other. More precisely, the lower part 8 has been folded towards the bale in a first step, whereupon the upper part 8' has been folded towards the part 8 in a second step. In other words, the part 8' is applied to the outside of the part 8. It should be evident, that the paper web constituting the cover 7 lies in several layers on top of each other in the folded parts 8, 8' which partly overlap each other.

The bale itself 6 usually has the form of a pressed, homogeneously continuous body of fibres. This fibre body is in the main parallelepipedical, e.g. having the size of 80×60×50 cm and a weight of about 200 kg. In some cases, the bale 6 or the contents of the cover 7 may consist of a plurality of relatively stiff sheets of fibre placed on each other, together forming a parallelepipedical body or bundle.

Reference is now made to FIGS. 3 to 6, which in detail illustrate a preferred embodiment of a punching device according to the invention. As may be most clearly seen in FIGS. 3, 4 and 6, each individual punching device 2 comprises a front jaw 9 in which there is an opening 10 in connection to which a protruding, edge-equipped cutting or punching tool 11 is arranged the purpose of which is to punch out sets of lugs in the overlapping parts 8, 8' of the paper cover 7 in a way which is closer described below in association with FIGS. 7 to 13. In the example shown (see FIG. 6), the opening 10 has essentially a rectangular or quadrangular form, while the punching tool 11 is mainly U-shaped and surrounds the opening 10. More precisely, this U-tool is turned to open upwards, in that the same comprises a lower first edge 12 from the opposite ends of which two vertical, mutually parallel edges 13, 13' extend. It should be evident, that when these edges cut through the paper in the cover 7, a set of lugs is created comprising a number of individual vertically down-hanging lugs corresponding to the number of paper layers.

Inside or behind the jaw 9 a dog or driver 14 is arranged, which is capable of swinging around a first hinge 15. The dog is in the form of an essentially J-shaped body having an arched finger 16 which is distanced from the hinge 15 so that the free end 16' of the finger (see FIG. 10) can move in an arch-shaped path. In the preferred embodiment, the jaw 9 forms a gable to a house, in its entirety designated 17, which is movably arranged in relation to the carriers 1' and 1" respectively (whose front wall is designated 18 in FIGS. 3 to 5). More precisely, the dog 14 is located in a frontal case-shaped portion 17' of the house 17. This case-shaped portion 17' of the house opens to the rear in a box-shaped portion 17" of the house. In said box-shaped portion, there is a suitably pneumatically driven piston-cylinder mechanism 19, the piston rod of which is connected to the dog 14 via a second hinge 20. A third hinge 21 connects the cylinder of the mechanism to the box-shaped portion 17" of the house. The house 17 is, in its entirety, spring-loaded by means of a spring 22, e.g. a screw compression spring, which always aims at moving the house to the position shown in FIG. 3 where the jaw 9 is at the maximum distance from the front wall of the carrier 18. In this position, a nut 23 on a dowel 24 of the box portion 17" serves as an adjustable stop for the house, more precisely by abutting against an inner wall 18' within the carrier 1' and 1". It should be particularly pointed out that the spring 22 in practice should be rather powerful, implying that the house 17 and the jaw 9 can be pressed into the carrier only by a relatively great force.

Figure 2:
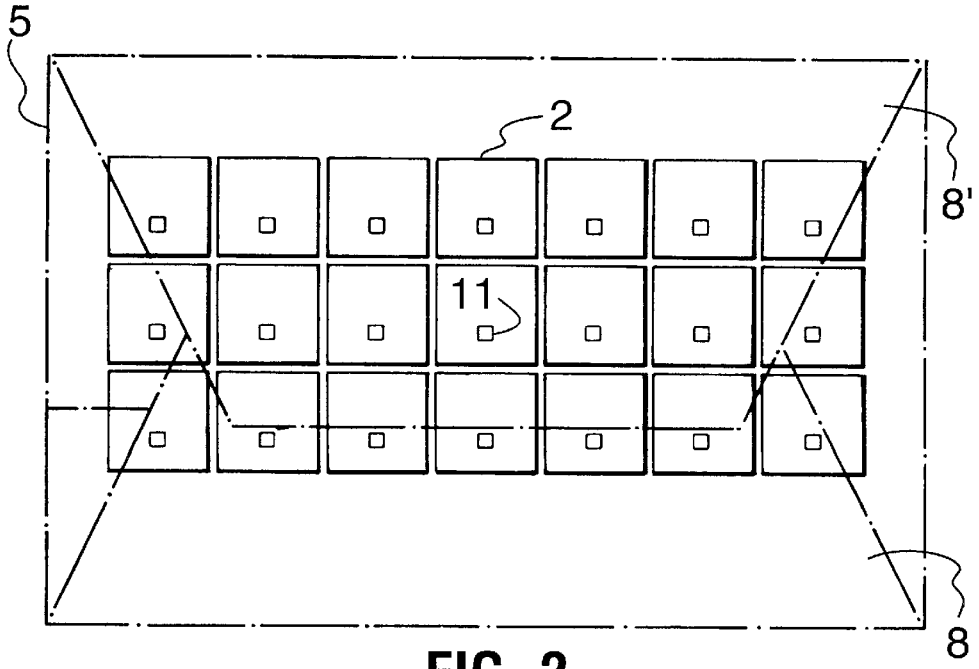
Figure 5:
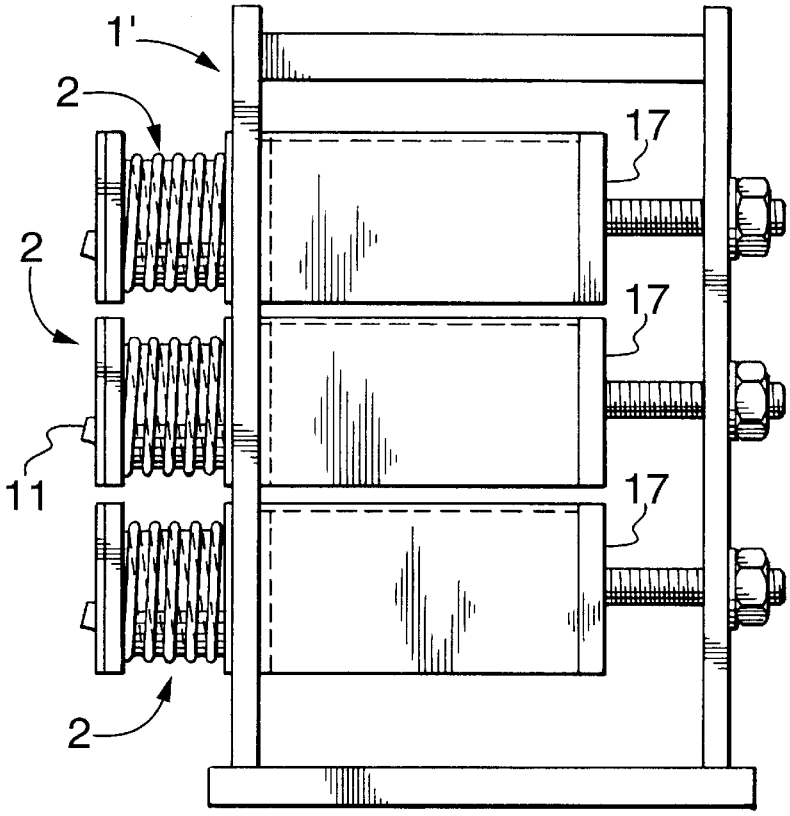
Figure 6:
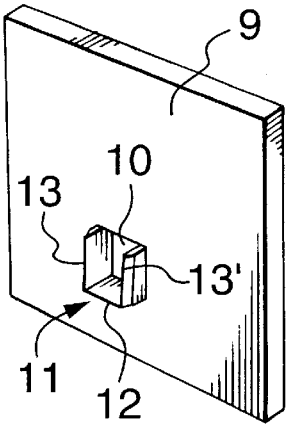
Figure 3:
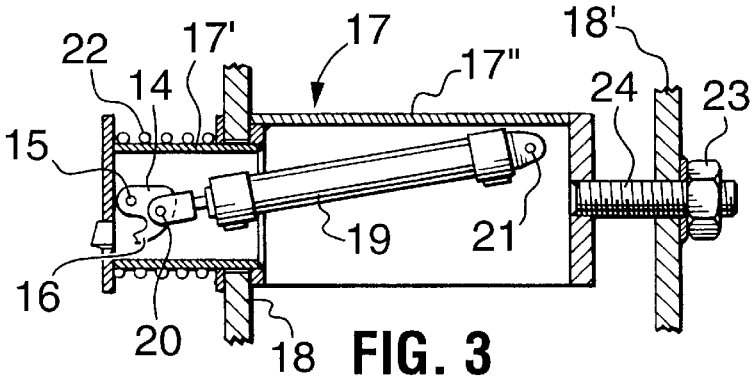
Figure 4:
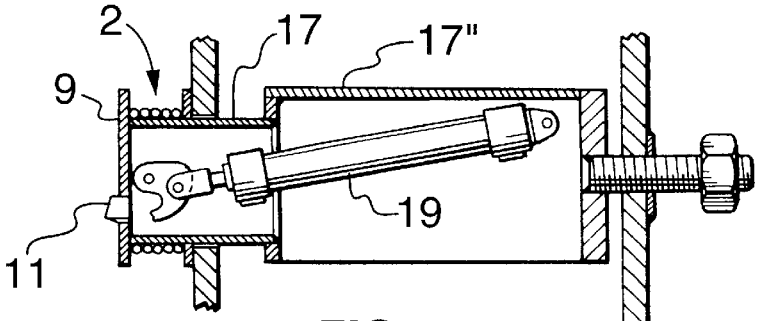

As may be seen in FIGS. 1, 2 and 5, each carrier 1', 1" comprises a plurality of punching devices divided in sets of rows 2. More precisely, the devices are placed in three rows separated level-wise with, in this case, seven devices in each row. Owing to the fact that each punching tool is individually movable in relation to the carrier in common, by separately being part of a movable, spring-loaded house of the kind described above, it is secured that the punching tools can reliably cut into the paper cover even if the lateral surface of the bale in question should be uneven.

Figure 7:
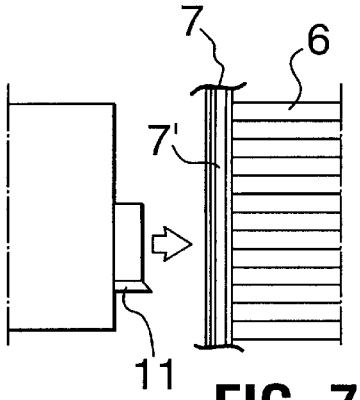
Figure 8:
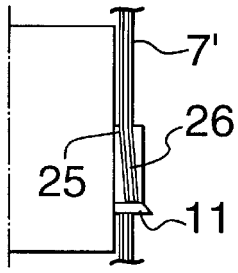
Figure 9:
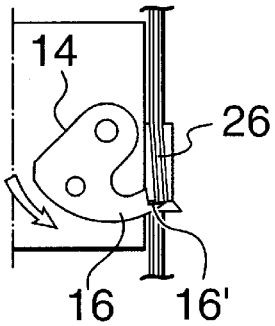
Figure 10:
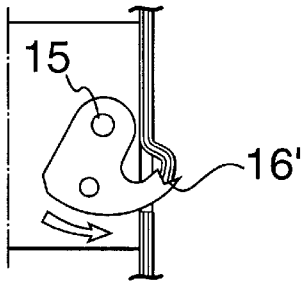
Figure 11:
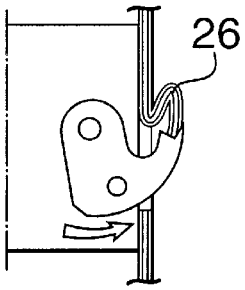
Figure 12:
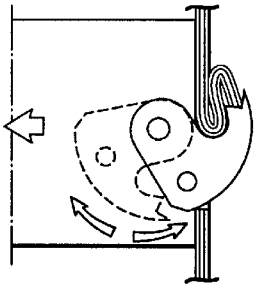
Figure 13:
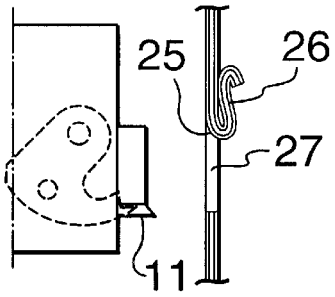

Reference is now made to 7 to 13 which in detail, though schematically, illustrate the different working steps during the punching of the required sets of lugs in the paper cover. In FIG. 7 a part of the proper pulp bale or the body of pulp fibre 6 is shown, while the paper cover in general is designated 7. In FIG. 7 the cover is shown comprising a number of layers of papers designated 7' lying on top of each other. These multiple layers of paper exist in different numbers in the area of the two overlapping parts 8, 8' along the lateral surfaces of the bale. When the U-shaped punching tool 11 is pressed against the layers of paper in the direction of the arrow in FIG. 7, the edges of the tool 12, 13, 13' will cut through all layers of paper as illustrated in FIG. 8. In this connection, individual U-shaped lugs are provided in each layer of paper, each lug hanging down vertically from horizontal folding lines which are designated 25 in FIG. 8. When the punching tool has reached its bottomed position in which the jaw 9 lies tight against the lateral surface of the pulp bale, the driver 14 is activated, more precisely in such a way that the same, by means of the cylinder 19, is turned in the direction of the arrow in FIG. 8. In doing so, the front portion 16' of the finger 16 (which is designed with an angular notch) will seize the free ends of the lugs 26. On continued turning of the driver, the free end 16' of the finger will move in an arch-shaped path around the hinge 15 and firstly pass through the opening 10 and then move outwardly/upwardly through the same. At last the driver will reach an upper end position, shown in full lines in FIG. 12. The driver has then introduced the set of paper lugs 26 in a folded-up state in the interface between the inner side of the paper cover and the outside surface of the proper pulp bale 6. When the driver is thereafter turned back to the position shown in FIG. 12 with dashed lines, the set of lugs 26 remains in its folded-up position where it is kept by means of at least a light squeezing action between the outer cover and the inner pulp bale. Finally, the punching device 11 is removed from the bale as illustrated in FIG. 13.

When both the carriers 1', 1" have been removed from the pulp bale 5' positioned in the wrapping station 1 according to FIG. 1, the paper cover 7 thereof will be reliably kept against the very body of the bale by means of a plurality of individual sets of lugs 26 in connection to each one of the holes 27 which have been punched in the cover.

Conceivable Modifications of the Invention

The invention is not limited solely to the embodiment described above and shown in the drawings. Thus, it is conceivable to use a few, e.g. only one, punching tools for locking the cover to the bale. In case several tools occur on each carrier, it is further conceivable to arrange the tool in a fixed position in relation to the carrier instead of the individually movable, spring-loaded arrangement as has been exemplified in the drawings. Further, it is conceivable to punch lugs with another shape than the rectangular one exemplified in the drawings. For example, the lugs and the through holes may have a triangular form, the individual punching tool consisting of only two edges arranged in a V-shape. Also, the required driver or dog for introducing the set of lugs behind the paper cover may be realized in another way than the one described above.

We claim:

1. A method for wrapping a pulp bale with a wrapping or cover (7) of paper, said wrapping or cover put around the bale and folded along opposite faces thereof while forming mutually overlapping parts (8, 8') in which the paper lies in a plurality of layers on top of each other, said wrapping being provided with holding means for holding against the bale, wherein one or more sets of lugs (26) are provided in the overlapping parts (8, 8') of the wrapping, each of said sets of lugs being made by jointly punching, from the paper layers lying on top of each other, a number of individual lugs corresponding to the number of layers, said lugs being folded along a common folding line (26) and jointly inserted between the inside of the innermost paper layer and the outside of the bale so as to be held therebetween.

2. A wrapped pulp bale comprising a wrapping (7) of paper enveloping said bale, which wrapping is folded along opposite faces of said bale while forming mutually overlapping parts (8, 8') in which the paper lies in two or more layers on top of each other, the wrapping being equipped with holding means to hold the same against the bale, wherein said holding means comprises sets of lugs (26) provided in said overlapping parts (8, 8') of said wrapping (7), each set of said sets comprising a number of lugs corresponding to the number of layers of paper (7'), said lugs being punched out from paper layers while leaving through holes (27) therein, and folded along a common folding line (25) as well as collectively inserted between the inside of the inner paper layer and the outside of the bale in order to be held therebetween.

3. The wrapped pulp bale according to claim 2, wherein said folding line (25) is located to the area of an upper part of the through hole (27) in the paper layers, the folded-in set of lugs (26) extending upwardly from said hole.

4. The wrapped pulp bale according to claim 2, wherein two or more sets of lugs separated level-wise are punched in the overlapping parts (8, 8') of the wrapping (7), with sets of lugs in each row.

5. The wrapped pulp bale according to claim 3, wherein two or more sets of lugs separated level-wise are punched in the overlapping parts (8, 8') of the wrapping (7), with sets of lugs in each row.

6. A punching device for preparation of a wrapped pulp bale, said bale being wrapped with a wrapping or cover of paper, said wrapping or cover being put around the bale and folded along opposite faces thereof while forming mutually overlapping parts in which the paper lies in a plurality of layers on top of each other, said wrapping being provided with holding means for holding against the bale, wherein one or more sets of lugs are provided in the overlapping parts of the wrapping; said punching device comprising a jaw which may be pressed against the bale and in which the there is at least one opening in association with which a protruding, edge-equipped cutting or punching tool is arranged, whose purpose is to jointly punch out sets of lugs in several layers of paper, and that a driver is moveable to and fro through said opening so as to fold and insert the punched set of lugs between the inside of the inner most paper layer and the outside of the bale itself, whereby a number of individual lugs corresponding to the number layers is jointly punched from the paper layers.

7. A punching device according to claim 6, wherein said driver is a body (14) which is placed behind the jaw (9) and may be swung around a hinge (15), said body having an arched finger (16) which is distanced from said hinge (15) to be able to move in an arch-shaped path with its free end (16').

8. A punching device according to claim 6, wherein said jaw (9) carrying the punching tool (11) constitutes a gable of a house (17) within which the driver body (14) is located, and that said house is movably arranged in relation to a carrier (1', 1") being common to several corresponding houses and actuated by a spring (22), which always aims at distancing the house and the punching tool (11) thereof from the carrier towards an external end position, and against the action of which the house and the punching tool are compressible in the direction towards the carrier.

9. A punching device according to claim 7, wherein said jaw (9) carrying the punching tool (11) constitutes a gable of a house (17) within which the driver body (14) is located, and that said house is movably arranged in relation to a carrier (1', 1") being common to several corresponding houses and actuated by a spring (22), which always aims at distancing the house and the punching tool (11) thereof from the carrier towards an external end position, and against the action of which the house and the punching tool are compressible in the direction towards the carrier.

10. A punching device according to claim 8, wherein said carrier (1', 1") comprises two or more sets or rows of tools separated level-wise, with several tools in each row.

* * * * *